US008353245B2

(12) United States Patent
Zinman

(10) Patent No.: US 8,353,245 B2
(45) Date of Patent: Jan. 15, 2013

(54) LINE ART TRANSFER FREEHAND COLOURING

(76) Inventor: Darryl Zinman, Montréal (CA)

( * ) Notice: Subject to any disclaimer, the term of this patent is extended or adjusted under 35 U.S.C. 154(b) by 911 days.

(21) Appl. No.: 11/892,042

(22) Filed: Aug. 20, 2007

(65) Prior Publication Data

US 2009/0050009 A1 Feb. 26, 2009

(51) Int. Cl.
*B44C 1/17* (2006.01)

(52) U.S. Cl. ..... 101/34; 101/4; 101/32; 156/240

(58) Field of Classification Search ..... 156/240; 101/4, 32, 34
See application file for complete search history.

(56) References Cited

U.S. PATENT DOCUMENTS

| | | | | | |
|---|---|---|---|---|---|
| 3,785,912 | A * | 1/1974 | Van Deusen | 428/202 |
| 3,930,092 | A * | 12/1975 | Shapiro | 428/204 |
| 4,038,123 | A * | 7/1977 | Sammis | 156/240 |
| 4,224,358 | A | 9/1980 | Hare | |
| 4,284,456 | A | 8/1981 | Hare et al. | |
| 4,313,994 | A * | 2/1982 | Kingston | 428/200 |
| 4,427,472 | A | 1/1984 | Trager | |
| 4,564,406 | A | 1/1986 | Binks | |
| 4,980,224 | A * | 12/1990 | Hare | 428/202 |
| 5,047,103 | A * | 9/1991 | Abrams et al. | 156/72 |
| 5,324,378 | A * | 6/1994 | Sieber | 156/240 |
| 5,795,420 | A * | 8/1998 | English | 156/64 |
| 5,833,790 | A | 11/1998 | Hare | |
| 5,914,176 | A * | 6/1999 | Myers | 428/195.1 |
| 6,080,261 | A * | 6/2000 | Popat et al. | 156/240 |
| 6,093,273 | A * | 7/2000 | Lee | 156/230 |
| 6,103,041 | A * | 8/2000 | Wagner et al. | 156/230 |
| 6,423,466 | B2 | 7/2002 | Hare et al. | |
| 6,506,445 | B2 * | 1/2003 | Popat et al. | 427/146 |
| 6,544,370 | B1 * | 4/2003 | Roberts et al. | 156/230 |
| 6,916,589 | B2 | 7/2005 | Hare et al. | |
| 7,008,746 | B2 | 3/2006 | Williams et al. | |
| 7,459,052 | B2 * | 12/2008 | Tweel et al. | 156/241 |
| 2002/0000288 | A1 * | 1/2002 | Boyd et al. | 156/240 |
| 2004/0067468 | A1 | 4/2004 | Davy | |
| 2004/0144481 | A1 * | 7/2004 | Poulos et al. | 156/230 |
| 2005/0076998 | A1 * | 4/2005 | Buffum et al. | 156/230 |
| 2008/0149263 | A1 * | 6/2008 | Dalvey et al. | 156/240 |
| 2009/0023586 | A1 * | 1/2009 | Zinman | 503/201 |

* cited by examiner

*Primary Examiner* — Ren Yan
*Assistant Examiner* — David Banh
(74) *Attorney, Agent, or Firm* — Equinox Protection; Franz Bonsang

(57) ABSTRACT

In a line art transfer free hand colouring printing technique, a design outline is first generated on a transfer substrate using a glutinous ink and is then applied to a surface, for example the front of a T-shirt. A user then applies colouring and/or texturing in and/or around the design in accordance with personal choice to create an image and thereafter a finishing is applied. The finishing comprises a sheet releasably carrying decorative transfer elements which upon application to the image highlights the outline only, the remainder of the image remaining unaffected by the finishing.

8 Claims, 5 Drawing Sheets

LINE ART TRANSFER FREEHAND COLOURING

FIELD OF THE INVENTION

The present invention relates to transfer printing in the general field of decalcomania.

More particularly, the invention has reference to transfer printing device for transferring a preformed outline design onto a surface which may be flexible or rigid, with freehand colouring. The invention also concerns a kit provided for effecting such transfer, for completing or in-filling the outline design on a customized basis, and further relates to a method of carrying out the whole procedure of line art transfer printing.

BACKGROUND OF THE INVENTION

Decalcomania as a decorative technique is well known and was conceived in the early part of the nineteenth century. It has been developed over the years with the many advances in technology that have occurred, especially during the last century.

The techniques that are currently available are legion, but there remains a niche for an improved transfer printing device and method of application that can facilitate usage by both amateur and professional artisans and allow the user to subsequently directly colour or texture the surface having the outline transferred thereon.

SUMMARY OF THE INVENTION

It is therefore a general object of the present invention to provide an improved transfer printing device, kit thereof and line art transfer free hand colouring printing method therefore.

A specific object of the present invention is to provide a transfer printing device which allows a preformed outline design to be transferred onto a surface for subsequent completion by the user employing colouring or texturing substances according to personal choice. It is to be understood that the expression 'outline' as used herein is intended to embrace not only the boundary outline of a design but also any and all line work or line art within the outline.

Another object of the invention is to afford the user the opportunity to create a personalized outline, which thus becomes a preformed design prior to the application to the surface intended to carry the outline.

A further object of the present invention provides for the application of a finishing to the completed design to yield a final image. The finishing may be provided for an enhancement of the image so created by highlighting the boundaries and/or preselected portions thereof as defined by the initial outlining.

Yet another object of the invention is to provide a transfer printing kit including transfer printing device of the kind indicated, colouring and/or texturing materials or means for infilling the preformed outline design, and the finishing.

A complementary object of the present invention is to provide a method of using said transfer printing kit for line art transfer free hand colouring.

A further general object of the present invention is to provide a transfer printing technique capable of use on a wide variety of surfaces of flexible or rigid nature.

According to a first aspect of the present invention, there is provided a transfer printing device comprising a transfer substrate in sheet form provided with a transfer side adapted to carry a preformed design outline of adhesive ink capable of being transferred onto a surface. Typically, the preformed design outline is of adhesive ink capable of receiving a finishing.

The transfer side of the substrate may carry the preformed design outline ab initio or the user may apply the design outline to the transfer side using the adhesive ink such that it becomes preformed prior to the transfer onto the surface. The intention is for the user to apply a customized or personalized colouring or texturing within or without the design outline using conventional materials for this purpose. Thus, thin colouring pigments such as dyes or fabric marker, fabric pastels, air brush, water based other colouring substances of a character that will not attract or hold other matter thereto, may be employed.

The finishing may be in the form of a sheet of material carrying decorative transfer elements such as reflective, fluorescent or phosphorescent, particles, beads or other particles such as sands or glitters, or color powders. The sheet of the finishing may be metallic sheet foil or may be a sheet or film produced from Mylar® as a carrier for particulate or pulverulent materials to be adhered thereto on a temporary basis.

In a second aspect of the present invention, there is provided a kit comprising at least one transfer printing device according to the first aspect of the invention, and colouring and/or texturing materials. Typically, the kit further includes at least one finishing for application to the transferred design outline when adhesive ink is used for the design outline.

The transfer printing device in sheet form may be provided in the kit with a preformed design outline, or in the alternative may be provided in blank form in which case the kit will include an adhesive ink for deployment by the user to create a personalized design outline.

The finishing may be provided in the kit in pre-prepared form, namely as a sheet or film carrying the decorative transfer elements. In the alternative, the finishing may be provided as a blank with an adherent surface, and a variety or plurality of decorative transfer elements is separately supplied within the kit for application to the adherent surface as determined by the user to yield the desired finishing.

A third aspect of the present invention provides a method of line art transfer freehand colouring printing from a transfer substrate in sheet form carrying on a transfer side thereof a preformed design outline of ink, the method including the steps of applying the transfer side of the sheet to a surface and effecting transfer of the design outline thereto, and generating an image within the design outline with the use of colouring and/or texturing substances within the transferred outline. Typically, the method further include the step of applying a finishing to the image by transferring the decorative transfer elements to said outline and/or preselected areas thereof, when adhesive ink is used for the design outline.

The application of the transfer of the design outline to the surface may be effected thermally under pressure if required or other suitable means.

The application of the finishing may similarly be effected by heat and/or pressure such that the decorative transfer elements are duly transferred by adherence to the adhesive ink of the outline.

The surface on which the image is to be carried may be provided by flexible as in the form of a textile, for example fabricated into a T-shirt, or may be a pliable plastics material to which the image may be transferred. In the alternative, the surface may be provided by rigid material, such as glass, metal, wood or plexiglass, the list not being exhaustive and being given by way of exemplification only.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
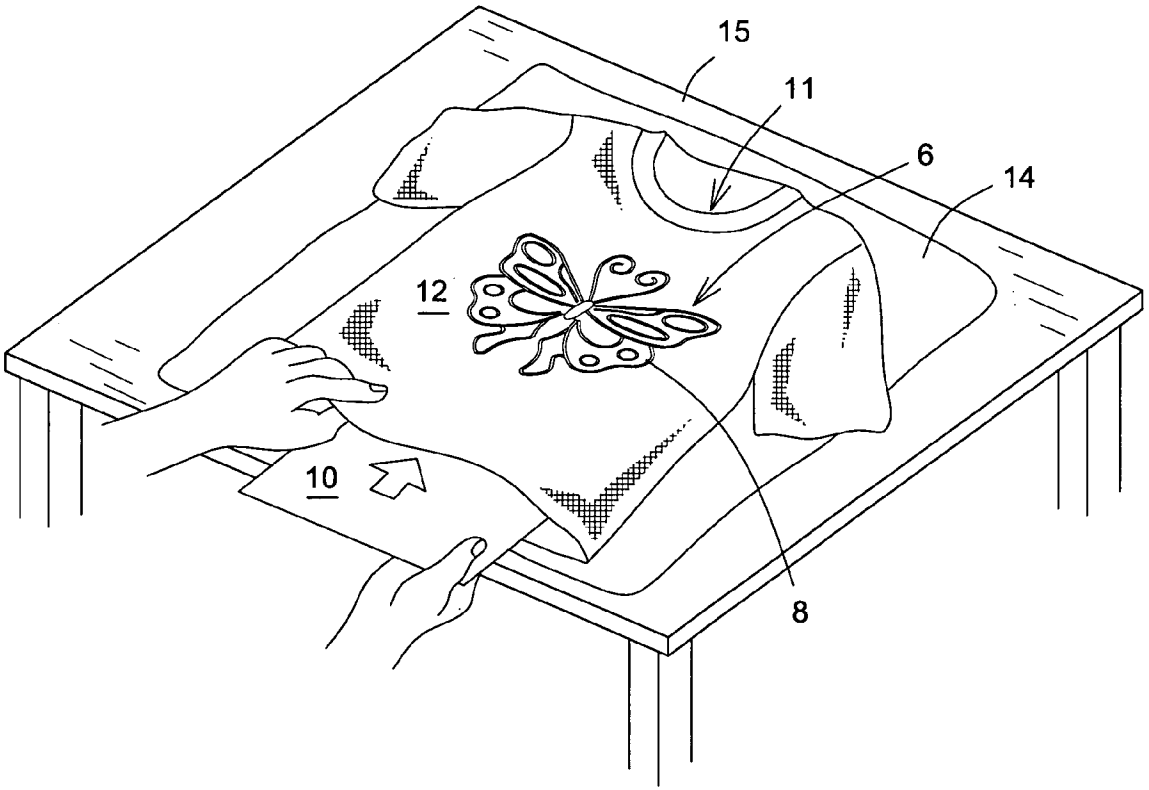
FIG. 1 is a top perspective view of a T-shirt overlying a table-top and carrying a preformed design outline.
Figure 1A:
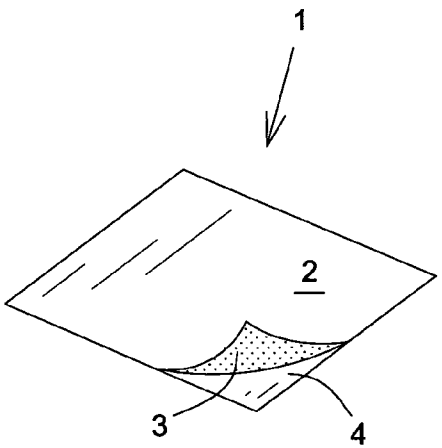
FIG. 1*a* is a top perspective view of an embodiment of a part of a kit for transfer printing in accordance with an embodiment of the present invention.

Referring to FIGS. 1*a* and 1, there is shown a transfer printing device in accordance with an embodiment of the present invention in the form of a transfer substrate 1 in the form of a sheet 2 being lifted from a protective layer 4. The sheet 2 carries on its transfer side 3 (shown as shaded) a preformed design outline 6 (not visible in FIG. 1*a*) in the shape, for example, of a butterfly 8, the outline 6 (including the linework) being depicted in double lines (see FIG. 1) after its application, the double lines herein being for the purpose of illustration only and representing in fact a single solid line different from the line of FIG. 5 (as explained hereinbelow). It will be appreciated that the outline 6 may be composed of lines of any thickness and/or density. It will further be understood that the sheet 2 may be blank ab initio and that the user may apply a personalized design outline 6. In both cases, the outline 6 is preferably generated using an adhesive ink, which term additionally includes a suitable glue or equivalent substance that possesses a glutinous quality for a purpose to be described infra.

In FIG. 1, there is shown a backing sheet 10 being typically inserted within a T-shirt 11 such that when heat and/or pressure is applied to the sheet 2 with its transfer side 3 in contact with the front 12 of the shirt 11 a positive transfer of the outline 6 is achieved without flow through to the back of the shirt. As can be seen, the shirt 11 is placed on a cover 14 on top of a table 15.

Figure 2:
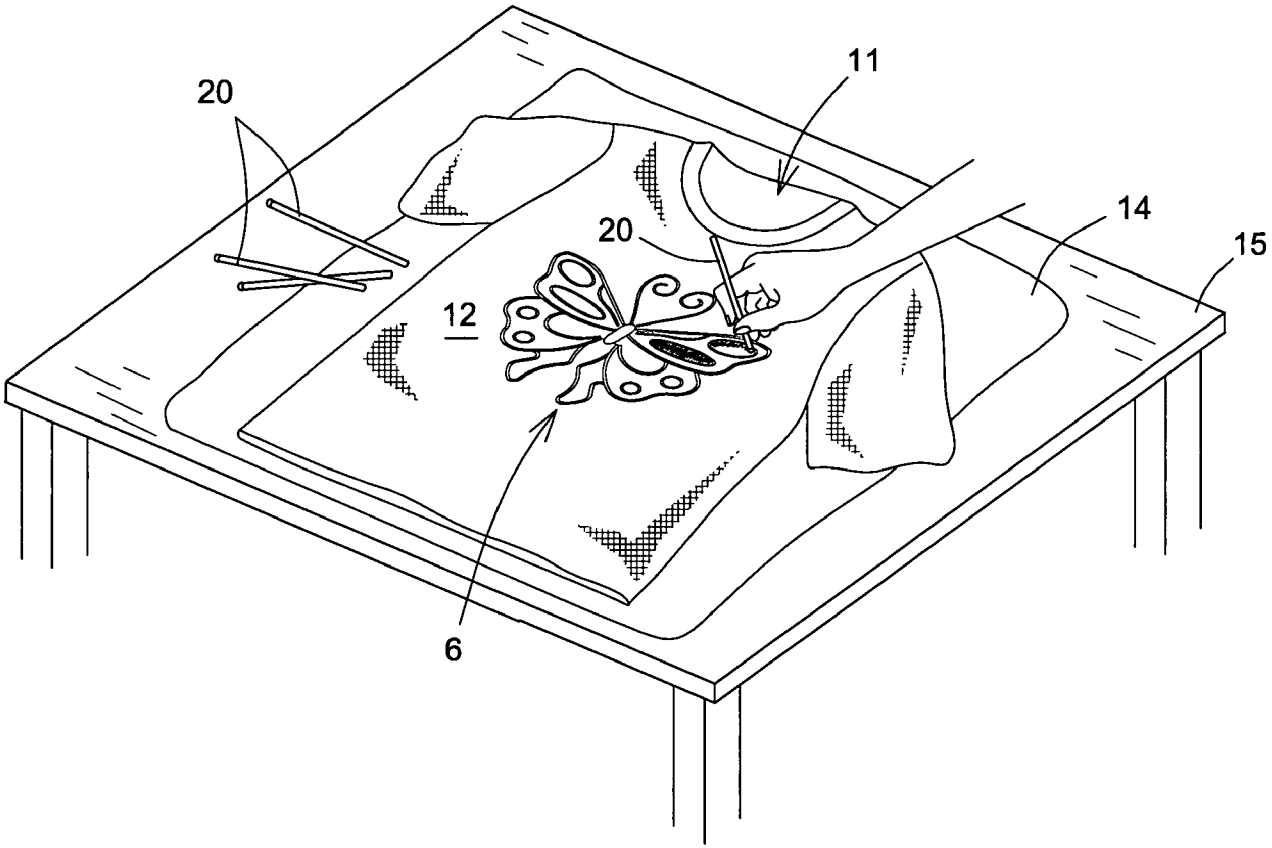
FIG. 2 is a similar view to that of FIG. 1 and illustrates the manual infilling of the design outline.

Typically, the outline 6 remains glutinous once it has been transferred to the front 12 of the shirt 11 as the first step of the line art transfer free hand colouring printing method in accordance with the present invention. As can be seen from FIG. 2, the second step of the process is generating a image within the outline with the user manually applying colouring, for example, with suitable crayons 20 such as pastel dye crayons or other colouring or texturing materials or substances or means to the areas bounded by the transferred outline 6 to give the customized image of the butterfly 8 carrying personally chosen hues.

Figure 3:
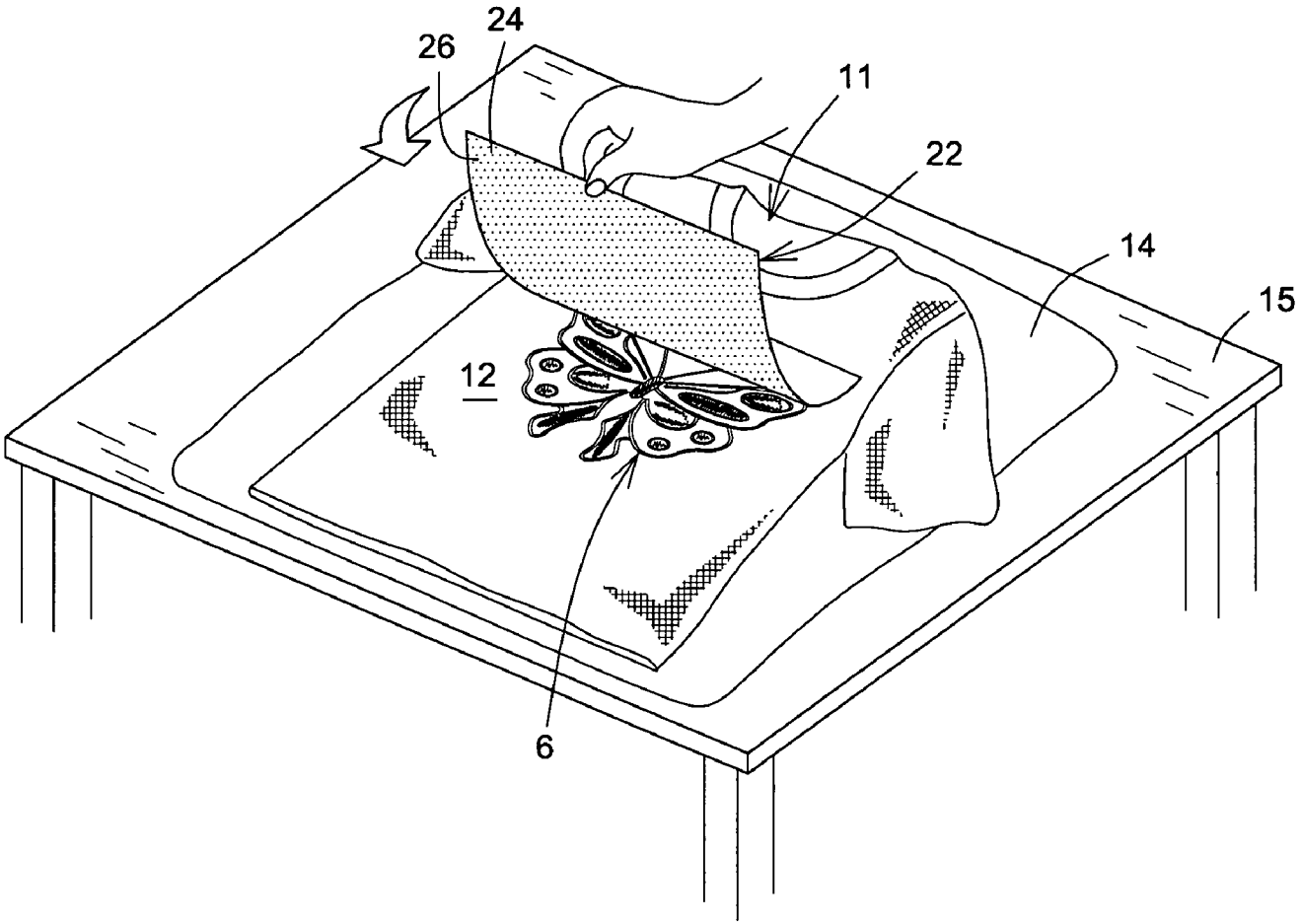
FIG. 3 is a further view similar to that of FIG. 1 and illustrates the application of a finishing to the infilled design outline.

The customized image of the butterfly 8 is seen in FIG. 3 with a finishing 22 being typically placed thereover within a third step of the printing method. The finishing 22 is in the form of a sheet or foil 24 carrying decorative transfer elements, shown as dots 26 in FIGS. 3 and 5. The transfer elements 26 may be selected by way of example only from the following non-exhaustive list, namely pigmented transfers, reflective, fluorescent or phosphorescent particles or powder, or sands or glitters, the surface of the sheet 24 being slightly adhesive but capable of releasing the elements upon application of heat and/or pressure.

Figure 4:
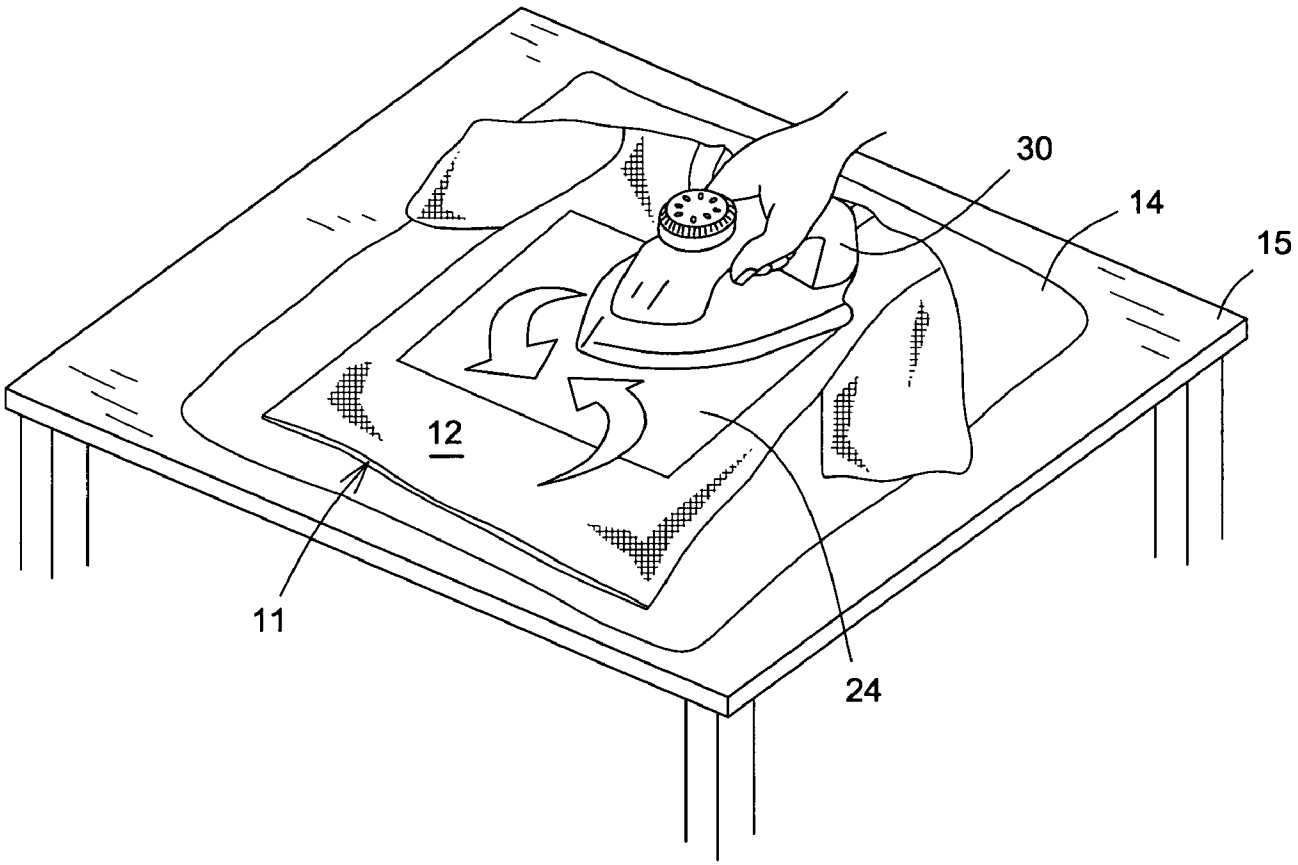
FIG. 4 is a view showing the application of heat and pressure to the finishing illustrated in FIG. 3.
Figure 5:
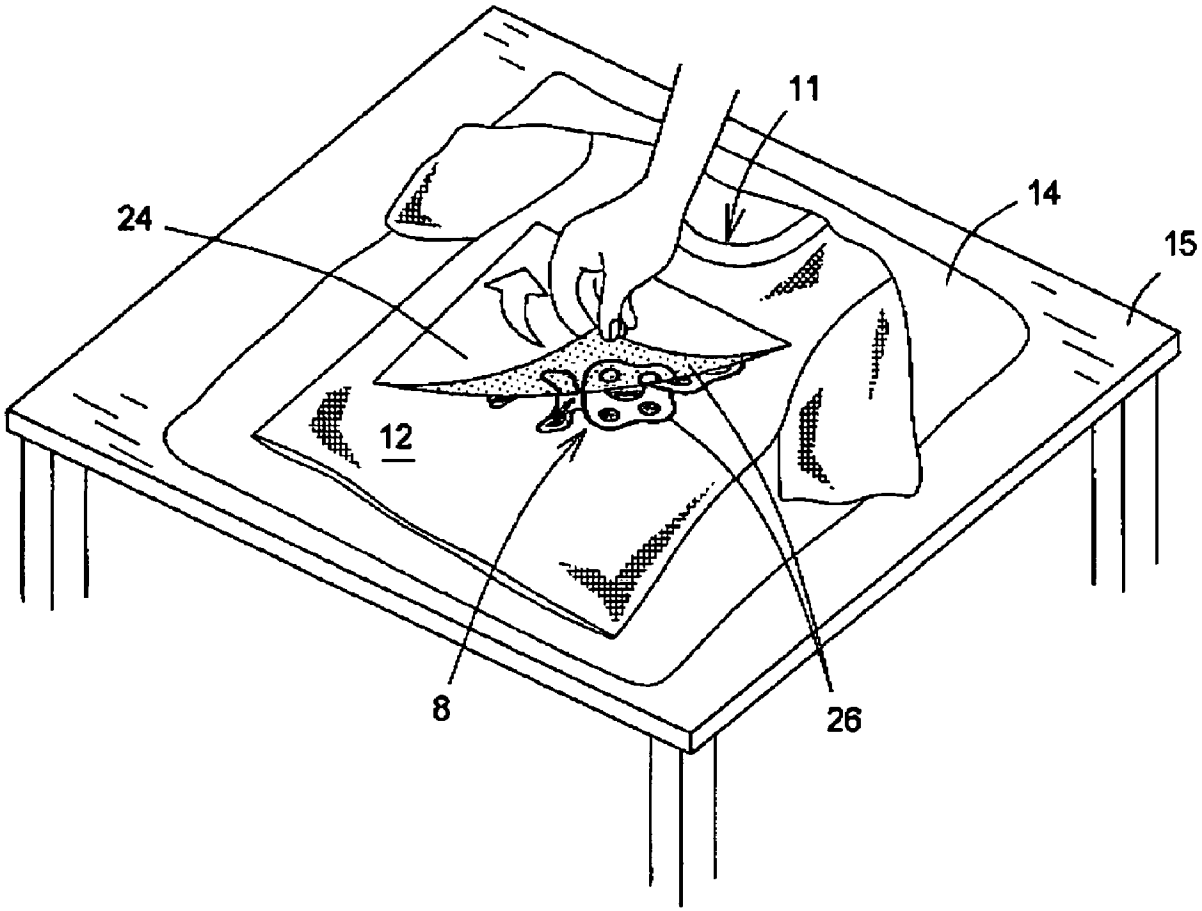
FIG. 5 is a view showing the removal of the finishing applied as depicted in FIG. 4.

Once the sheet 24 is placed face down onto the customized image of the butterfly 8, an electric iron 30 for example is used to apply heat and pressure as shown in FIG. 4 and in so doing the transfer elements 26 are duly transferred by adherence to the glutinous outline 6 only. The heat and pressure fix the elements 26 and the outline 6 which accordingly highlights the image in the manner desired. In FIG. 5 the finishing sheet 24 is shown being removed from the front 12 of the shirt 11, the outline 6 of the butterfly image 8 now being depicted in single solid lines.

A kit represents an important aspect of the present invention, and accordingly the kit comprises at least one substrate sheet adapted to carry a glutinous design outline, colouring and/or texturing media or materials or substances for application within the transferred design outline for the generation of a customized image, and at least one finishing composed of a sheet carrying decorative transfer elements for transfer to the outline to highlight the image.

While a specific embodiment has been described, those skilled in the art will recognize many alterations that could be made within the spirit of the invention, which is defined solely according to the following claims.

I claim:

1. A method of line art transfer free hand colouring printing from a transfer substrate in sheet form carrying a linework of adhesive ink of a preformed design outline on a transfer side thereof, the method comprising the steps of;

applying the transfer side of the sheet to a surface and effecting transfer of the linework of the design outline thereto;

generating an image on the surface within the transferred design outline with the use of at least one colouring and/or texturing substance; and applying a finishing to the image by transferring on the surface a portion of at least one solid surface decorative transfer element onto the adhesive ink of said linework and/or preselected areas thereof, the finishing being in the form of a sheet carrying the at least one solid surface decorative transfer element separatable therefrom by the adhesive ink, a remaining portion of the at least one solid surface decorative transfer element not overlying said linework remaining onto the sheet un-transferred onto the surface, whereby said portion of the at least one solid surface decorative transfer element being only transferrable onto the adhesive ink so as to prevent said remaining portion of said at least one solid surface decorative transfer element from transferring on the surface on areas of the outline exempt of adhesive ink, and hiding a portion of said image extending over said linework.

2. A method according to claim 1 wherein the application of the transfer of the design outline to the surface is effected thermally and/or under pressure.

3. A method according to claim 1 wherein the finishing is applied thermally and/or under pressure such that the portion of the at least one decorative transfer element is transferred by adherence to the adhesive ink of the linework of the design outline.

4. A method according to claim 2 wherein the finishing is applied thermally and/or under pressure such that the portion of the at least one decorative transfer element is transferred by adherence to the adhesive ink of the linework of the design outline.

5. A method according to claim 1 wherein generating an image includes free hand application on the surface of the at least one colouring and/or texturing substance within said transferred outline.

6. A method according to claim 2 wherein generating an image includes free hand application on the surface of the at least one colouring and/or texturing substance within said transferred outline.

7. A method according to claim 3 wherein generating an image includes free hand application on the surface of the at least one colouring and/or texturing substance within said transferred outline.

8. A method according to claim 4 wherein generating an image includes free hand application on the surface of the at least one colouring and/or texturing substance within said transferred outline.

* * * * *